US008763180B1

(12) United States Patent
Tsai

(10) Patent No.: US 8,763,180 B1
(45) Date of Patent: Jul. 1, 2014

(54) HEIGHT ADJUSTABLE PILLOW

(71) Applicant: Dongguan Tiger Point Metal & Plastic Products Co., Ltd., Guang Dong Province (CN)

(72) Inventor: Chun-Chung Tsai, New Taipei (TW)

(73) Assignee: Dongguan Tiger Point Metal & Plastic Products Co., Ltd., Dongguan (CN)

( * ) Notice: Subject to any disclaimer, the term of this patent is extended or adjusted under 35 U.S.C. 154(b) by 0 days.

(21) Appl. No.: 14/105,562

(22) Filed: Dec. 13, 2013

(30) Foreign Application Priority Data

Jan. 11, 2013 (CN) ..... 2013 2 0013766 U

(51) Int. Cl.
*A47C 20/00* (2006.01)
*A47G 9/10* (2006.01)

(52) U.S. Cl.
CPC ..... *A47G 9/1027* (2013.01)
USPC ..... 5/640; 5/622; 5/636; 5/637; 5/655.3; 5/657

(58) Field of Classification Search
CPC ..... A47G 9/10; A47G 9/1027; A47G 9/1081; A47G 9/109; A47C 7/383; A61G 13/121
USPC ..... 5/640, 622, 636, 637, 655.3, 657; 2/468, DIG. 3
See application file for complete search history.

(56) References Cited

U.S. PATENT DOCUMENTS

| | | | | |
|---|---|---|---|---|
| 4,617,691 | A * | 10/1986 | Monti et al. | 5/640 |
| 6,058,517 | A * | 5/2000 | Hartunian | 2/468 |
| 6,219,865 | B1 * | 4/2001 | Stokesbary | 5/637 |
| 6,625,829 | B2 * | 9/2003 | Zell | 5/637 |
| 8,239,987 | B2 * | 8/2012 | Sharp | 5/639 |
| 8,382,692 | B1 * | 2/2013 | Chao | 602/18 |
| 2011/0113557 | A1 * | 5/2011 | Aguilera | 5/640 |
| 2012/0047656 | A1 * | 3/2012 | Benton et al. | 5/640 |
| 2012/0124748 | A1 * | 5/2012 | Soto et al. | 5/640 |
| 2013/0025058 | A1 * | 1/2013 | Yamamoto et al. | 5/640 |
| 2013/0232696 | A1 * | 9/2013 | Halimi et al. | 5/640 |

* cited by examiner

*Primary Examiner* — Robert G Santos
*Assistant Examiner* — David E Sosnowski
(74) *Attorney, Agent, or Firm* — Rabin & Berdo, P.C.

(57) ABSTRACT

A height adjustable pillow includes a neck support portion and a chin support portion integrally formed with the neck support portion. The neck support portion is used for surrounding the neck of a user while the chin support portion is used for supporting the chin of the user, has a cylindrical shape and is formed with a first Velcro strap at one side thereof. The neck support portion is formed with a second Velcro strap for adjustably connecting the first Velcro strap. An inflate valve is mounted on one of the neck support portion or the chin support portion for inflating and deflating.

8 Claims, 6 Drawing Sheets

HEIGHT ADJUSTABLE PILLOW

CROSS-REFERENCE TO RELATED APPLICATION

This application claims the priority of Chinese patent application No. 201320013766.4, filed on Jan. 11, 2013, which is incorporated herewith by reference.

BACKGROUND OF THE INVENTION

1. Field of the Invention

The present invention relates to a pillow, more particularly to an adjustable pillow, wherein a chin support portion of the pillow can be adjusted.

2. Description of the Prior Art

A conventional table pillow has a semi-circle shape, is generally an inflatable body that is usually placed on a table, so that the user can rest thereon. Hence, the table pillow temporarily supports the user neck while he or she rests thereon so as to prevent him suffering from undesired neck pain and that tiredness will not overcome him. When a person is in the sleeping situation, the entire muscles and the body is in a relaxed state such that the head is subjected to lean forward or the head is subjected to move in the leftwise and rightwise directions. Under this circumstance, the neck is unable to withstand the weight and movement the head in the rightwise and leftwise directions, thereby resulting in tiredness of the neck. In addition, when one is undergoing chiropractic treatments, he or she must raise his head at an appropriate level with respect to the chest so as to quicken or correct his spinal position. Therefore, it an urgent task for an inventor to invent a height adjustable pillow in order to meet the market demand and which can cushion the chin as well as the head of a user while he rests thereon.

SUMMARY OF THE INVENTION

The objective of the present invention is to eliminate the disadvantages of the prior art and to provide a height adjustable pillow for a person to rest thereon or to be used while a person is undergoing chiropractic treatments so as to cushion the weight of the user's head and neck. Moreover, a relative height between a chin support portion and a neck support portion of the present pillow is adjustable in order to provide a comfort feeling to the user.

In order to achieve the abovementioned objective, a height adjustable pillow of the present invention includes a neck support portion for surrounding the neck of a user and a chin support portion that is used for supporting the chin of the user and that is formed with a first Velcro strap at one side thereof. The neck support portion is formed with a second Velcro strap for adjustably connecting the first Velcro strap.

The neck support portion is generally U-shaped in order to surround the neck of the user such that the user can rest thereon. The chin support portion is connected erectly to the neck support portion.

The neck support portion has top and bottom sides when the user rests thereon. The chin support portion has two opposite ends protruding outwardly from the top and bottom sides of the neck support portion. The first Velcro strap extends along one side of the chin support portion.

Preferably, the chin support portion has a cylindrical shape. The first Velcro strap is an elongated strap mounted continuously along a longitudinal length of the chin support portion.

Alternately, the first Velcro strap is divided into a plurality of minor straps mounted along the longitudinal length of the chin support portion spaced apart from one another.

In one preferred embodiment, the neck support portion and the chin support portion are integrally formed with each other.

The neck support portion preferably has opposite first and second sides. The chin support portion has one side connected to the first side of the neck support portion and the other side defining a gap together with the second side of the neck support portion. At this time, the first Velcro strap is mounted on the other side of the chin support portion while the second Velcro strap is mounted on the second side of the neck support portion.

Since the neck support portion and the chin support portion are integrally formed with each other, the neck support portion and the chin support portion are spatially communicated relative to each other. The pillow of the present invention further includes an inflatable valve mounted either on the neck support section or the chin support portion for inflating and deflating.

In another preferred embodiment, the neck support portion and the chin support portion are separately formed so that the neck support portion and the chin support portion are not spatially communicated relative to each other.

Preferably, the first Velcro strap is divided into two first minor straps for mounting on two longitudinal sides of the chin support portion. In the same manner, the second Velcro strap is also divided into two second minor straps for mounting on two opposite sides of the neck support portion corresponding to the first minor straps.

In another preferred embodiment, each of the neck support portion and the chin support portion is provided with an inflatable valve for deflating and inflating.

The advantages provided by the height adjustable pillow of the present invention are as follows:

(1) Since the neck support portion and the chin support portion are designed in an integral manner and are able to connect with each other (through first and second Velcro straps), the height between the chin support portion and the neck support portion can be adjusted in order to cushion an individual head relative to the neck so that the present pillow is suitable for use during a long flight, taking a nap in the office or school or while one is undergoing chiropractic treatment.

(2) The first Velcro strap is designed in an elongated strap or non-continuous minor straps. The simple design provides ample usages.

(3) Owing to the cylindrical shape of the chin support portion, the first Velcro strap in the elongated form can be mounted along the longitudinal length of the chin support portion, which, in turn, provides adjustment of height between the chin support portion and the neck support portion.

(4) The chin support portion and the neck support portion are integrally formed and hence are in spatially communicated relative to each other so as to form an inflatable body. An inflatable valve is provided at one of the neck and chin support portions for inflating and deflating. When inflated, the present pillow can cushion the user's neck and chin, thereby eliminating tiredness of the user's neck and shoulder. When deflated, the present pillow occupies a little storage space and hence convenient to carry along or transportation.

(5) When the neck support portion and the chin support portion are separately formed, the damaged ones can be discarded and is can be replaced by new ones, thereby economizing the user's expense.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENTS

Figure 1:
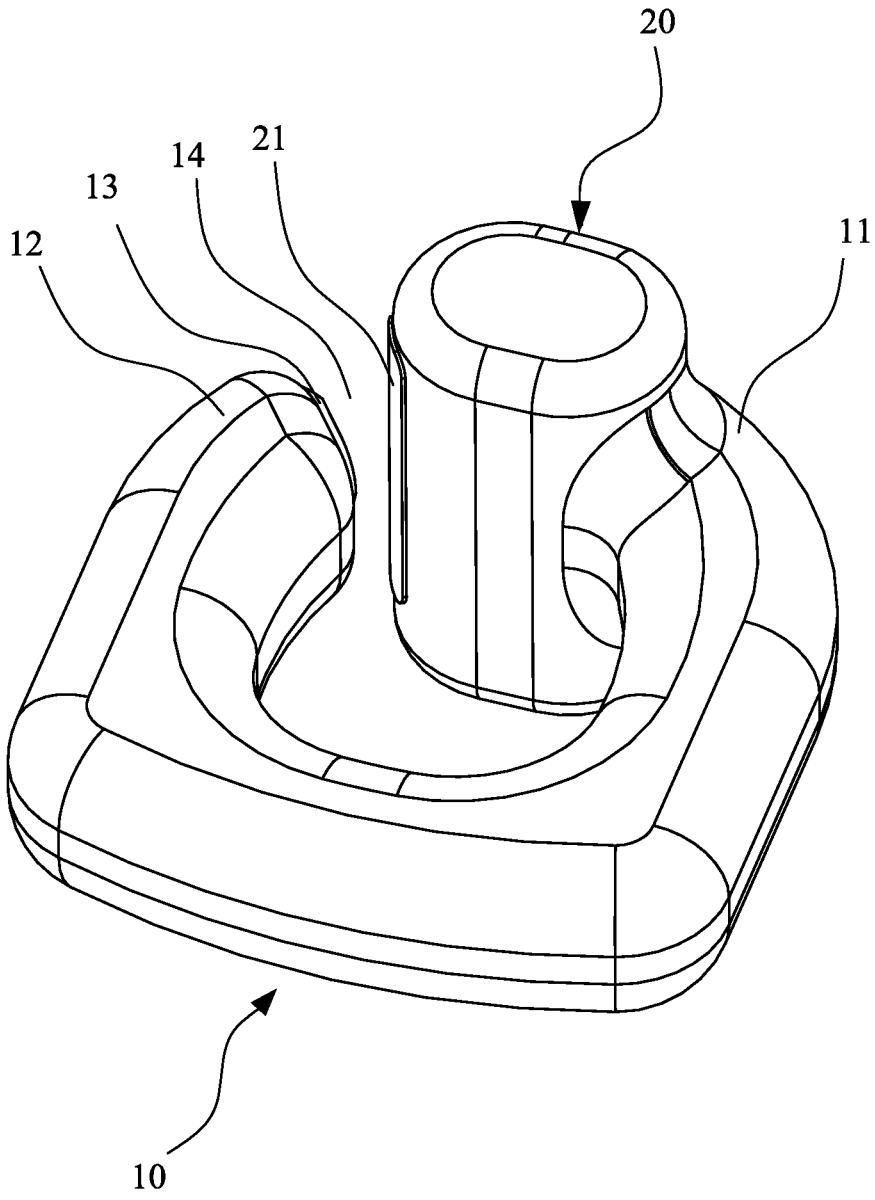
FIG. 1 shows a schematically perspective view of the first embodiment of a height adjustable pillow of the present invention.
Figure 2:
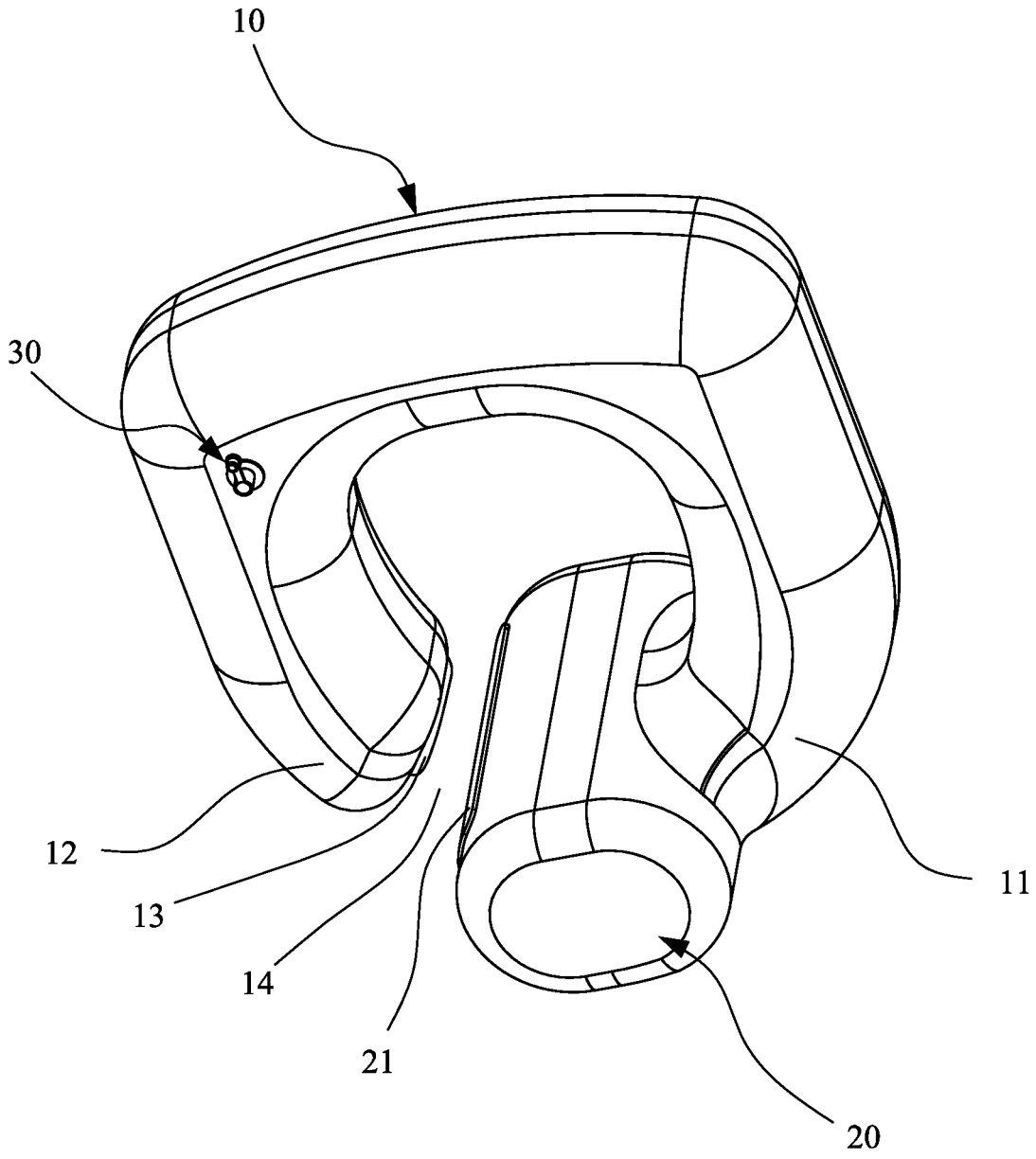
FIG. 2 shows a bottom view of the first embodiment of the height adjustable pillow of the present invention.
Figure 3:
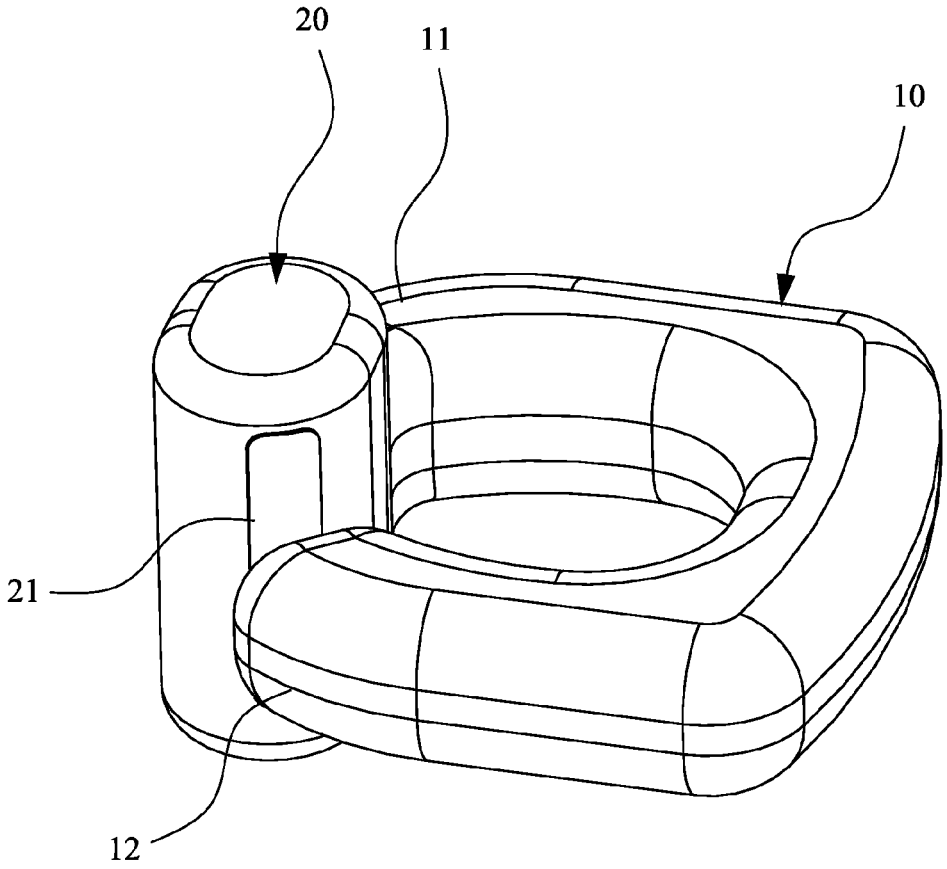
FIG. 3 shows a schematically perspective view of the first embodiment of the height adjustable pillow of the present invention from another angle.
Figure 4:
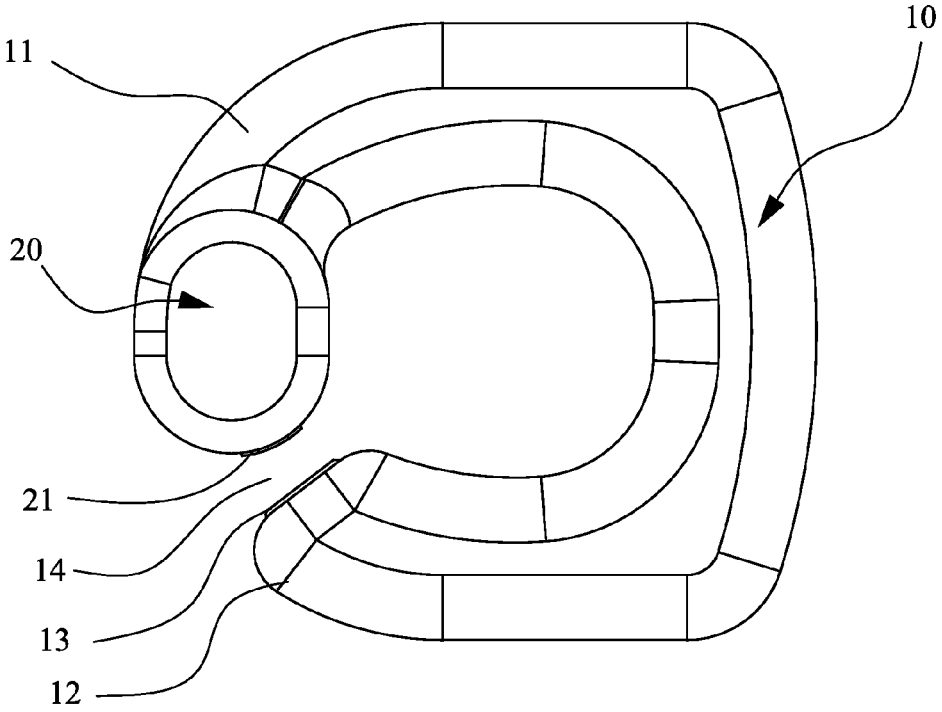
FIG. 4 shows a top planar view of the first embodiment of the height adjustable pillow of the present invention.
Figure 5:
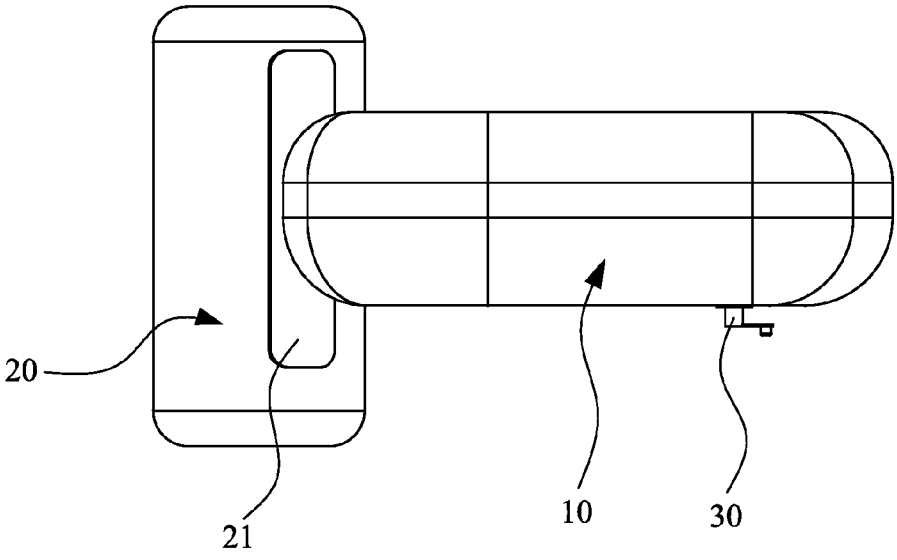
FIG. 5 is a lateral side view of the first embodiment of the height adjustable pillow of the present invention illustrating one type of Velcro strap employed therein.
Figure 6:
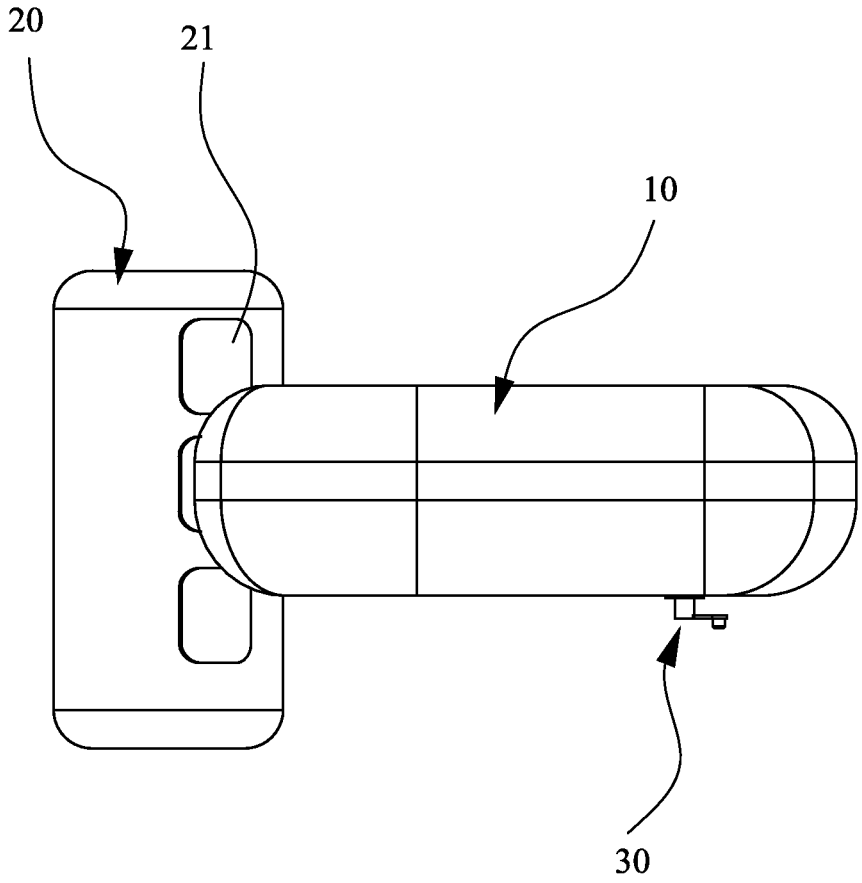
FIG. 6 is a lateral side view of the first embodiment of the height adjustable pillow of the present invention illustrating another type of Velcro strap employed therein.

Referring to FIGS. 1 to 6, wherein FIG. 1 shows a schematically perspective view of the first embodiment of a height adjustable pillow of the present invention. As illustrated, the height adjustable pillow accordingly includes a neck support portion 10, a chin support portion 20 and an inflatable valve 30. The neck support 10 and the chin support portion 20 are integrally formed with each other and are made from elastic materials, such as plastics or rubber. Preferably, the neck support 10 and the chin support portion 20 are integrally formed with each other so as to form an inflatable body in such a manner that the neck support portion 10 and the chin support portion 20 are spatially communicated relative to each other. The inflatable valve 30 is mounted either on the neck support section 10 or the chin support portion 20 for inflating such that once inflated, the inflatable body of the pillow can be used for supporting a user's neck while undergoing chiropractic treatment or upon which the user can rest thereon. Hence, the height adjustable pillow of the present invention is suitable for use when traveling, taking a nap in the offices or while a person is undergoing for chiropractic treatments.

Of course, the pillow of the present invention can be made from other materials, such as foam or cotton, rather than the elastic materials. The neck portion 10 and the chin support portion 20 can be stuffed with foam or cotton so long as the two portions serve as the inflatable body and provide the cushioning function.

In the present embodiment, the neck support portion 10 is generally U-shaped in order to surround the neck of the user such that the user can rest thereon. However, the configuration of the neck portion 10 should not be limited only to the U-shape, but should include other configuration. The U-shaped neck portion 10 has opposite first and second sides 11, 12. The chin support portion 20 has one side connected to the first side 11 of the neck support portion 10 and the other side defining a gap 14 together with the second side 12 of the neck support portion 10 (see FIG. 1). The other side of the chin support portion 20 is formed with a second Velcro strap 21.

The chin support portion 20 has a cylindrical shape and is adapted to cushion a user's chin when he rests thereon. The chin support portion 20 is connected erectly to the neck support portion 10. The neck support portion 10 has top and bottom sides when the user rests thereon. The chin support portion 20 has two opposite ends protruding outwardly from the top and bottom sides of the neck support portion 10 in accordance with ergonomic design of human body such that in use the chin of the user is raised apart from the user's chest at an appropriate level. In addition, the chin support portion 20 is formed a first Velcro strap 13 at one side thereof. Preferably, the first Velcro strap 13 is mounted on the second side of the neck support portion 10 while the second Velcro strap 21 is mounted on the other side of the chin support portion 20 for adjustably connecting the first Velcro strap 13. In this preferred embodiment, the second Velcro strap 21 is an elongated strap (see FIG. 5) mounted continuously along a longitudinal length of the chin support portion 20. Alternately, the second Velcro strap 21 is divided into a plurality of minor straps (see FIG. 6) mounted along the longitudinal length of the chin support portion 20 spaced apart from one another to facilitate adjustment of the chin support portion 20 relative to the neck support portion 10.

In the present preferred embodiment, the inflatable valve 30 is mounted on a bottom side of the neck support section 10 for inflating such that once inflated, the inflatable body of the pillow can be used for supporting a user's neck so that the user will not feel discomfort since the neck needs not bear the weight of the user's head. When not in use, the height adjustable pillow of the present invention can be deflated so as to form a compact size to facilitate carrying along, transport or thus occupies a small amount of storage space for storing and transportation.

Figure 7:
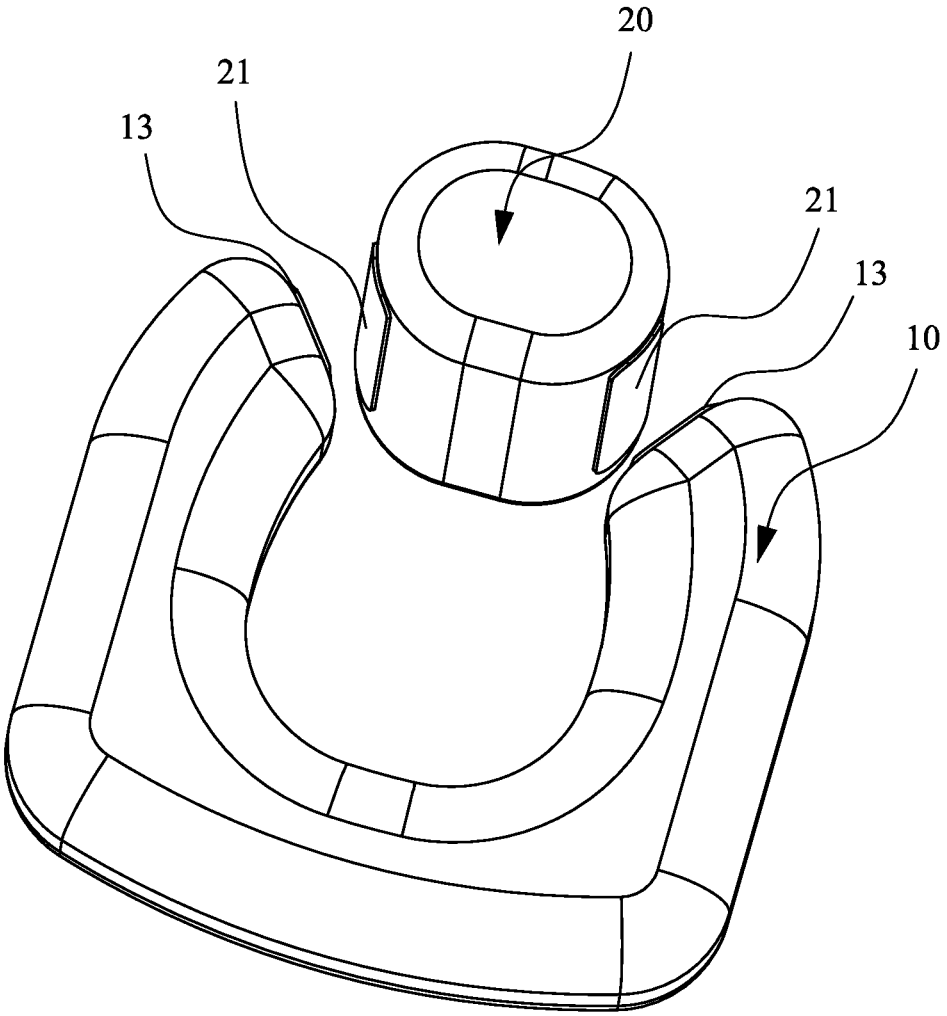
FIG. 7 shows a schematically perspective view of the second embodiment of the height adjustable pillow of the present invention.

FIG. 7 shows a schematically perspective view of the second embodiment of the height adjustable pillow of the present invention. The second embodiment has the structure similar to the first embodiment, except that the neck support portion 10 and the chin support portion 20 are separately formed. The first Velcro strap 13 is divided into two first minor parts mounted respectively on two opposite sides of the neck support portion 10. The second Velcro strap 21 is also divided into two second minor parts mounted respectively on two opposite sides of the chin support portion 20 for adjustably connecting with the first minor parts.

While the invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

The invention claimed is:

1. A height adjustable pillow comprising:

a neck support portion for surrounding the neck of a user; and a chin support portion for supporting the chin of the user, the chin support portion having a cylindrical shape and being formed with a first hook-and-loop strap at one side thereof, said neck support portion being formed with a second hook-and-loop strap for connecting with the first hook-and-loop strap so as to adjust the height of the chin support portion with respect to the neck support portion, wherein the second hook-and-loop strap is disposed at a terminal end of the neck support portion, and wherein the chin support portion has a top end which protrudes vertically from and above a top surface of the next support portion and a bottom end which extends vertically from and below a bottom surface of the neck support portion.

2. The height adjustable pillow according to claim 1, wherein said neck support portion is generally U-shaped in order to surround the neck of the user such that the user can rest thereon, said chin support portion being connected erectly to said neck support portion.

3. The height adjustable pillow according to claim 1, wherein said first hook-and-loop strap is either an elongated strap mounted continuously along a longitudinal length of the chin support portion or is divided into a plurality of minor straps mounted along the longitudinal length of the chin support portion, the minor straps being spaced apart from one another.

4. The height adjustable pillow according to claim 1, wherein said neck support portion and said chin support portion are integrally formed with each other.

5. The height adjustable pillow according to claim 4, wherein said neck support portion has opposite first and second sides, said chin support portion has a first side connected to said first side of said neck support portion and a second side defining a gap together with the second side of said neck support portion, said first hook-and-loop strap being mounted on the second side of said chin support portion while said second hook-and-loop strap being mounted on the second side of said neck support portion.

6. The height adjustable pillow according to claim 4, wherein said neck support portion and said chin support portion are integrally formed with each other so that said neck support portion and said chin support portion are spatially communicated relative to each other, the pillow further comprising a valve mounted either on said neck support section or said chin support portion for inflation and deflation of the portion to which it is mounted.

7. The height adjustable pillow according to claim 1, wherein said neck support portion and said chin support portion are separately formed.

8. The height adjustable pillow according to claim 7, wherein said neck support portion and said chin support portion are inflatable, each of said neck support portion and said chin support portion being provided with a valve for inflation and deflation of the portions.

* * * * *